US005913987A

United States Patent [19]

Sung et al.

[11] Patent Number: 5,913,987

[45] Date of Patent: Jun. 22, 1999

[54] FINISH TREATMENT METHOD AND SILICON STEEL SHEET MANUFACTURED BY DIRECT CASTING METHOD

[75] Inventors: Jin Kyung Sung, Seoul; Moon Chul Kim; Byoung Mu Do, both of Pohang, all of Rep. of Korea

[73] Assignees: Pohang Iron & Steel Co., Ltd.; Research Institute of Industrial Science & Technology, both of Pohang, Rep. of Korea

[21] Appl. No.: 08/989,070

[22] Filed: Dec. 11, 1997

[30] Foreign Application Priority Data

Dec. 13, 1996 [KR] Rep. of Korea ..... 96-65178

[51] Int. Cl.[6] ..... H01F 1/147; H01F 1/14

[52] U.S. Cl. ..... 148/111; 148/112; 164/459; 164/476; 164/477

[58] Field of Search ..... 148/110, 111, 148/112; 164/459, 476, 477

[56] References Cited

U.S. PATENT DOCUMENTS

| | | | |
|---|---|---|---|
| 5,049,204 | 9/1991 | Iwanaga et al. | 148/111 |
| 5,051,138 | 9/1991 | Iwanaga et al. . | |
| 5,720,335 | 2/1998 | Osada et al. | 164/475 |

FOREIGN PATENT DOCUMENTS

| | | |
|---|---|---|
| 9548472 | 11/1995 | Rep. of Korea . |
| WO95/26242 | 10/1995 | WIPO . |

OTHER PUBLICATIONS

Korean Patent Application No. 95–48472. Abstract, Dec. 11, 1995, 1 p., English language.

"Fe–3.25%Si Strip Produced by Melt Drag Process", Jin K. Sung et al., No. 384, Abstracts of the 117th Meeting of JIM (1995), p. 389.

"Annealing effect on grain texture of cold–rolled 4.5% Si–Fe ribbons prepared by a rapid quenching method", Ken Ichi Arai et al., J. Appl. Phys. 64(10), Nov. 15, 1988, 5373–5375.

"Texture and Magnetic Properties of Rapidly Quenched Fe–6.5wt%Si Ribbon", C.F. Chang et al., IEEE Transactions on Magnetics, vol. Mag–20, No. 4, Jul. 1984, pp. 553–558.

"A Study of Ferrous–Based Soft Magnetic Materials for Transformer and Similar Applications", T.F. Foley et al., Journal of The Iron and Steel Institute, Feb. 1970, pp. 147–156.

*Primary Examiner*—John Sheenan

*Attorney, Agent, or Firm*—Webb Ziesenheim Bruening Logsdon Orkin & Hanson, P.C.

[57] ABSTRACT

A method for manufacturing a soft magnetic steel sheet is disclosed. The silicon steel sheet is made to undergo a finish treatment so that it can be put to the practical use. The finish treatment method for an Fe-Si silicon steel sheet manufactured by a direct casting method by directly contacting a molten pool to a cooling roll according to the present invention includes the step of pickling the manufactured Fe-Si silicon steel sheet, and carrying out a cold rolling. Then the silicon steel sheet thus cold-rolled is heat-treated at a temperature above 0.5 Tm (Tm: melting temperature of the steel sheet).

13 Claims, 6 Drawing Sheets

FINISH TREATMENT METHOD AND SILICON STEEL SHEET MANUFACTURED BY DIRECT CASTING METHOD

BACKGROUND OF THE INVENTION

1. Field of the Invention

The present invention relates to a method for manufacturing a soft magnetic steel sheet for use as the iron core of transformers, motors and the like. More specifically, the present invention relates to a method for manufacturing a silicon steel sheet showing a low iron or core loss and a high magnetic flux density, in which the silicon steel sheet is manufactured by a direct casting method, and then a rolling and a heat treatment are carried out.

2. Description of the Prior Art

Generally, the non-oriented silicon steel sheet is manufactured in the following manner. That is, an ingot is hot-rolled and cold-rolled, and then, an annealing is carried out to relieve the stress. In this silicon steel sheet thus manufactured, it is demanded that the soft magnetic material properties (iron loss) should be superior. Therefore, all the process steps of the conventional method concentrate on minimizing the iron or core loss.

The known methods for reducing iron or core loss of silicon steel sheet include a method of facilitating the movements of the magnetic domains, a method of increasing the resistivity, and a method of forming an advantageous texture and decreasing a disadvantageous texture. Specifically, in order to facilitate the movements of the magnetic domains by improving the purity, impurities such as oxygen, carbon, nitrogen and titanium are removed. In the method of increasing the resistivity, the contents of elements such as silicon, aluminum and manganese are increased. In this context, care should be exercised in such a manner that the ductility of the silicon steel sheet should not be aggravated. Further, even in materials having the same composition, the magnetic properties are varied in accordance with the major grain orientation, and therefore, efforts have been made to improve the magnetic properties by resorting to the texture. For example, it is known that if tin and antimony are added, the crystallographic plane (200) which is favorable to the magnetic properties is increased.

However, the conventional method for manufacturing the silicon steel sheet by using an ingot reached a limit in purifying the material, in adding alloying elements, and in improving the texture.

Meanwhile, recently, a direct casting method which is quite different from the conventional methods has been developed. In the silicon steel sheet manufactured by the direct casting method, a high density (200) texture is observed even at a thickness of more than 200 $\mu$m, as well as showing superior magnetic properties.

The present inventor also proposed a method for manufacturing a high (200) plane density silicon steel sheet by employing a single rolling process in Korean Patent Application No. 95-48472 (dated Dec. 11, 1995). However, the silicon steel sheet which is manufactured by the direct casting method does not show a good flatness, because the sheet is directly cast in the molten pool. Further, its thickness is irregular, and therefore, a large stacking is difficult. Therefore, it could not be put to the practical use. Actually in the case of Fe-2.5%Si in a direct casting method, the surface roughness of the sheet is about 5 $\mu$m as shown in FIG. 1, and therefore, it cannot be used as it is. Further, in the case where the content of Si is high, the silicon steel sheet which is manufactured by the direct casting is brittle, and therefore it cannot be put to the practical use, in spite of its superior magnetic properties.

SUMMARY OF THE INVENTION

The present invention is intended to overcome the above described disadvantages of the conventional techniques.

Therefore it is an object of the present invention to provide a method for manufacturing a soft magnetic steel sheet, in which a silicon steel sheet manufactured by a direct casting method and having a high density (200) texture is subjected to a proper finish treatment, so as to reduce surface defects and thickness deviations, to lower the internal stress, and to provide superior magnetic properties.

In achieving the above object, the finish treatment method for an Fe-Si silicon steel sheet manufactured by a direct casting method by directly contacting a molten pool to a cooling roll according to the present invention includes the steps of: pickling the manufactured Fe-Si silicon steel sheet, and carrying out a cold rolling; and heat-treating the silicon steel sheet thus cold-rolled at a temperature of 0.5 Tm (Tm: melting temperature of the steel sheet).

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

The soft magnetic material which can be applied to the finish treatment of the present invention may be any Fe-Si soft magnetic material. Preferably it should be Fe-1.5–4%Si steel sheet.

The steel sheet which is obtained in the present invention is a silicon steel sheet having a thickness of 200 $\mu$m or more, preferably 300–500 $\mu$m, while the sheet should maintain a high density (200) texture. It does not matter whether the silicon steel sheet is manufactured by a single roll or twin roll casting method.

In the present invention, for the purpose of improving the magnetic properties and the texture of the silicon steel sheet, there are added one or two elements selected from among Al, Mn and Sn into the major ingredients of Fe and Si. Al should be preferably added by 1.2% or less, Mn by 1.2% or less, and Sn by 0.3% or less.

The reason why the contents of Al and Mn are limited to 1.2% or less is that if more are added, the ductility of the sheet is aggravated, and therefore, the cold rollability is aggravated. Further, if Sn is added by more than 0.3%, it is segregated on the grain boundaries, thereby aggravating the magnetic properties.

The sheet which has the above mentioned composition and is manufactured by a direct casting is subjected to a finish treatment. That is, first a pickling is carried out to remove the surface oxides. Then a cold rolling is carried out to improve the surface roughness. Thus a sheet which can be practically used is produced.

Under this condition, the reduction rate should be preferably 80% or less. The reason is that if the reduction rate is high, cracks are apt to be formed. If the cast sheet is cold-rolled at a reduction rate of 15% or less, then the surface roughness can be controlled to less than 1 $\mu$m.

Unlike the general understanding, there is an astounding fact such that the original (200) texture can be maintained intact even after the cold rolling.

Figure 1:
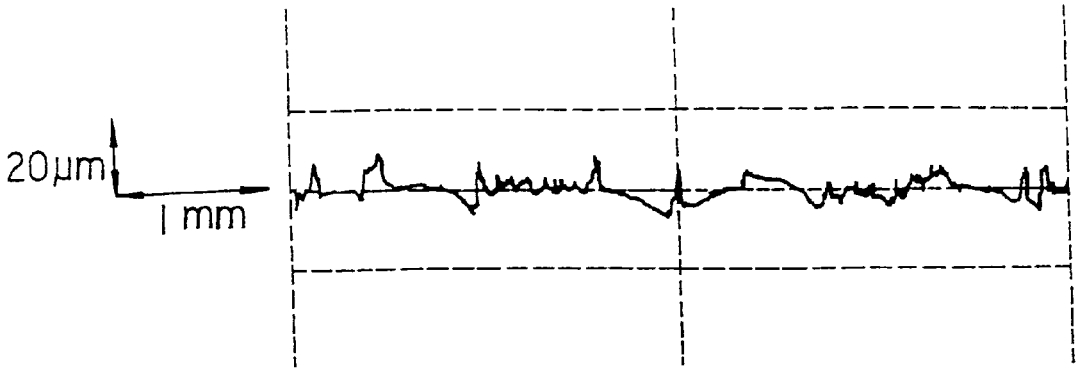
FIG. 1 is a graphical illustration showing the surface conditions of the silicon steel sheet manufactured by the general direct casting method.
Figure 2:
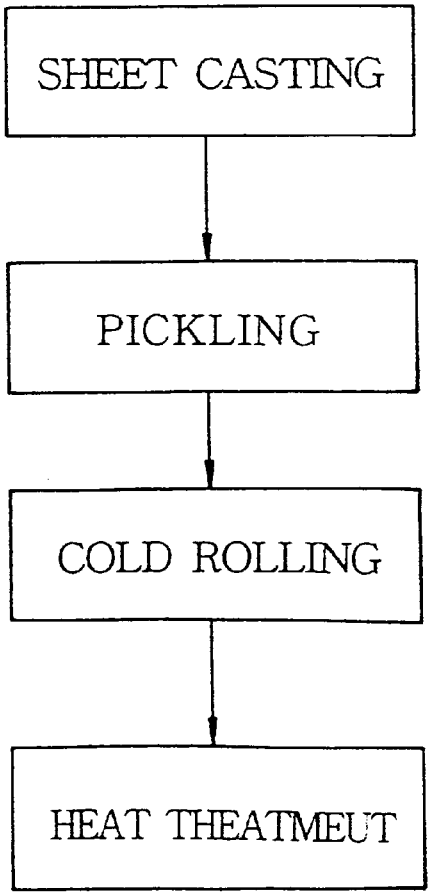
FIG. 2 is a flow chart showing the constitution of the finish treatment method according to the present invention.
Figure 3:
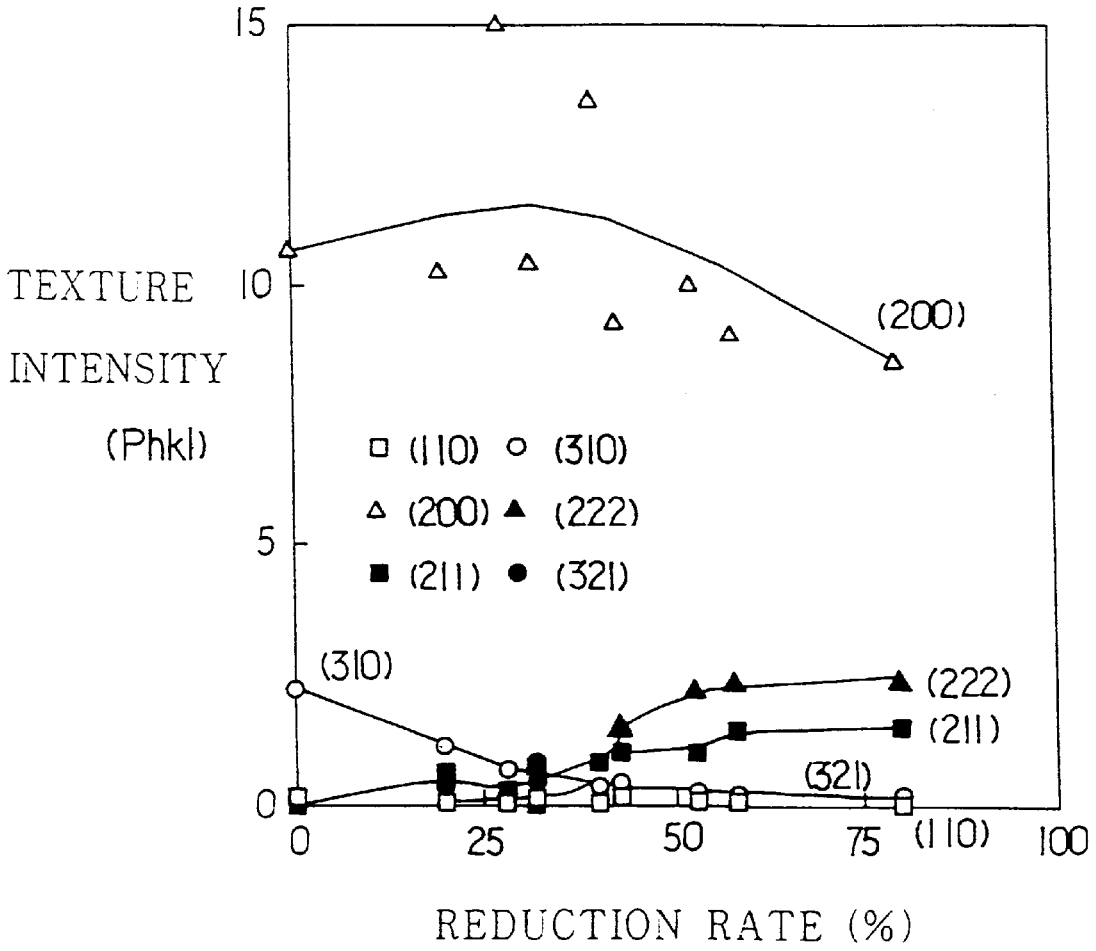
FIG. 3 is a graphical illustration showing the variation of the texture versus the reduction rate of the directly cast silicon steel sheet.

FIG. 3 illustrates the concentrations of the (200) textures of the direct cast sheet and the rolled sheet. As shown in FIG. 3, the sheet of the present invention holds a high density (200) texture immediately after the directing casting (at a reduction rate of 0%). The plane intensity ($P_{200}$) shows a value of about 10, and even after the rolling, $P_{200}$ is about 10, thus showing a high density (200) texture. This reflects the fact that the plane (200) parallel to the face of the sheet does not cause any variation during the rolling.

Meanwhile, although the rolled sheet has a high concentration of the plane (200), if the magnetic properties are to be improved, a heat treatment should be carried out so as to relieve the internal stress.

The temperature of the heat treatment should be higher than 0.5 Tm (Tm: the melting point of the sheet in °K), if recrystallizations are made to occur. More preferably, the temperature of the heat treatment should be 600° C. or over. However, if the temperature is over 1250° C., it is not desirable commercially.

The important aspects of the heat treatment in the present invention are as follows. That is, if the heat treatment is carried out at a temperature of 600–900° C., then the texture of the plane (200) which is advantageous to the magnetic properties is greatly developed. However, if the temperature is higher than 1000° C., then the texture of the (200) plane is drastically reduced, and instead, the texture the plane (222) which is disadvantageous to the magnetic properties is developed. However, the magnetic properties become more superior in the case of over 900° C. rather than in the case of 600–900° C. This is understood to be due to the fact that although the texture of the plane (200) is aggravated owing to the high temperature heat treatment, the grain size is increased.

Therefore, if the finish treatment of the present invention is applied by carrying out a heat treatment at a temperature of 600–900° C. after a cold rolling, there is an advantage that a high concentration plane (200) can be formed.

Most preferably, the heat treatment is carried out at a temperature of 1050–1250° C.

Further, in the present invention, even if the heat treatment is carried out for only 3 minutes, the magnetic properties can be favorably affected.

Now the present invention will be described based on actual examples.

Example 1

Table 1 shows the variation of the magnetic properties versus the reduction rate, for the case where an Fe-2.5%Si steel sheet is manufactured with a direct casting method, and is heat-treated at a temperature of 1050° C. The magnetic properties were superior regardless of the reduction rate. The reason why the magnetic properties were not affected by the reduction rate was that the texture was not greatly varied in accordance with the reduction rate as shown in FIG. 3.

<TABLE 1>

| Example | Reduction rate (%) | Iron loss ($W_{15/50}$, W/kg) | Flux density ($B_{50}$, kg) |
|---|---|---|---|
| Conventional material | 0 | 2.9 | 16.0 |
| Inventive material 1 | 15 | 2.1 | 16.9 |
| Inventive material 2 | 29 | 2.14 | 16.5 |
| Inventive material 3 | 42 | 2.3 | 16.6 |
| Inventive material 4 | 58 | 1.95 | 17.2 |
| Inventive material 5 | 80 | 2.2 | 16.7 |

Example 2

In order to look into the influence of the temperature of the heat treatment, magnetic properties were measured both for a sheet without undergoing a finish treatment and for an Fe-2.5%Si sheet with the finish treatment done. The variation of the iron loss is illustrated in FIG. 4, while the magnetic flux density is shown in FIG. 5.

Figure 4:
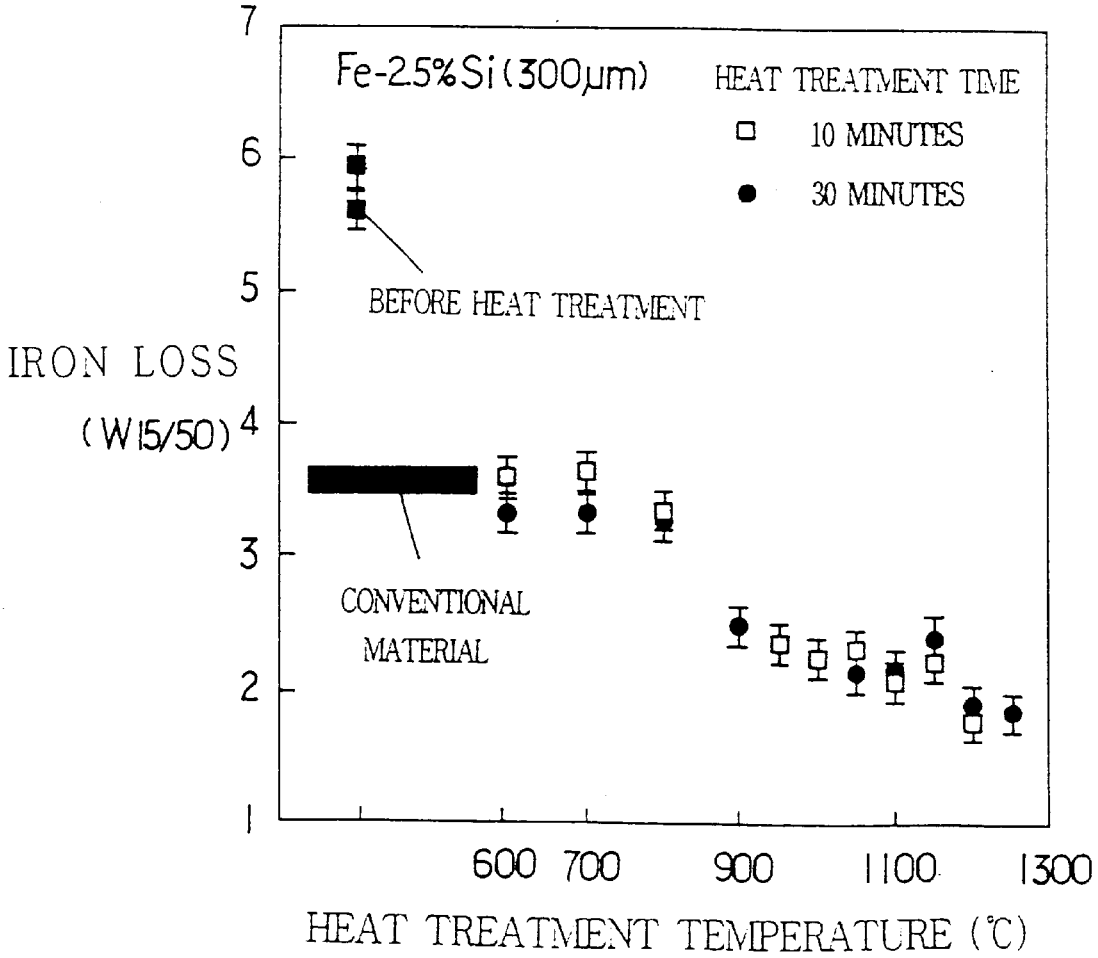
FIG. 4 is a graphical illustration showing the variation of the iron loss versus the heat treatment conditions for the directly cast silicon steel sheet.
Figure 5:
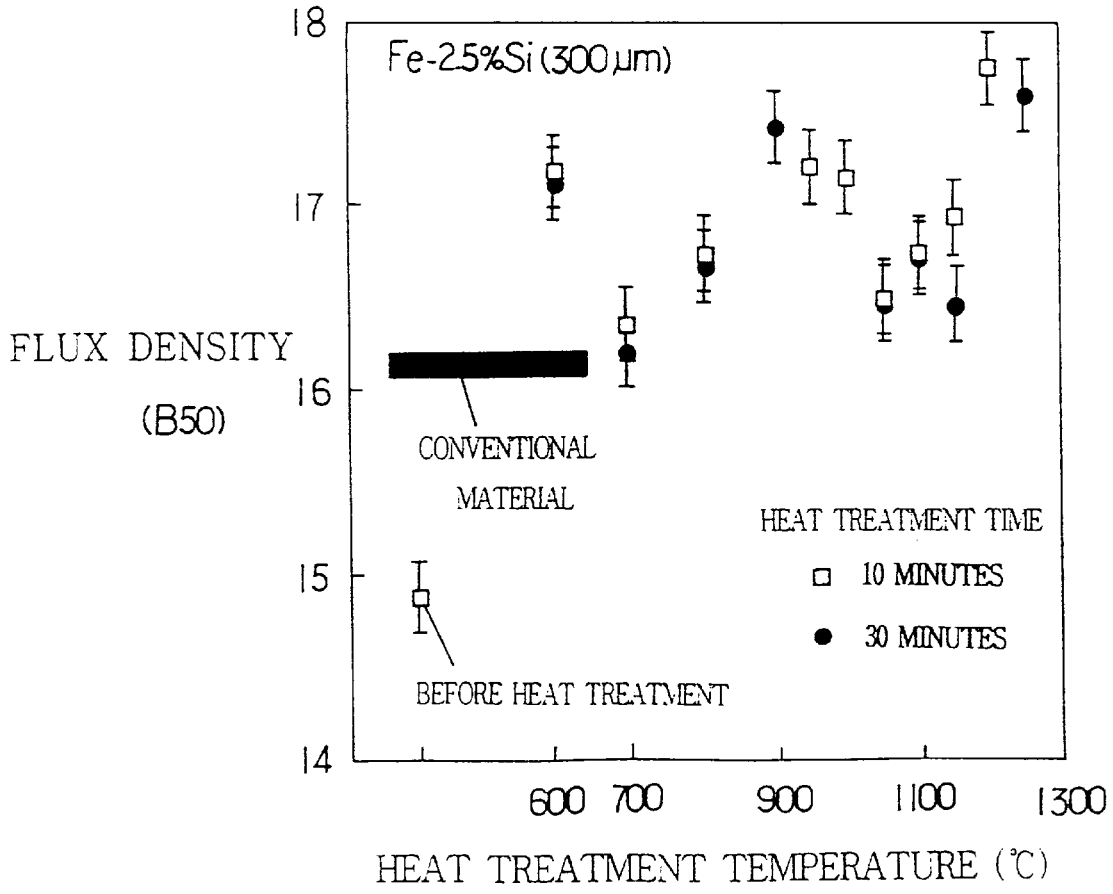
FIG. 5 is a graphical illustration showing the variation of the magnetic flux density versus the heat treatment conditions for the directly cast silicon steel sheet.

As shown in FIG. 4, in the case where the heat treatment was carried out at a temperature of 600–900° C., the iron loss was 3.3 W/Kg which is superior to the iron loss of a non-oriented electrical steel sheet with similar chemical composition (the conventional material). Further, when the heat treatment was carried out at a temperature of 900–1250° C., the iron loss was decreased to less than 2.5 W/Kg, thus showing a superior magnetic property. Further, as shown in FIG. 5, the heat treatment was carried out at a temperature of over 600° C., the magnetic flux density showed to be 17.0±0.4 KG. These magnetic properties are a level superior compared with the commercial electrical steel sheet.

Specifically, the commercial non-oriented electrical steel sheet (S14: Fe-2.5%Si-0.3%Al-0.3%Mn, 350 $\mu$m thick) (the conventional material) has magnetic properties as follows. That is, they are $W_{15/50}$=3.6 W/Kg, and $B_{50}$=16.2 KG. Meanwhile, the highest quality non-oriented electrical steel sheet (S6: Fe-3.2%Si-0.8%Al-0.9%Mn-0.2%Sn, 350 $\mu$m thick) shows an iron loss of $W_{15/50}$=2.3 W/Kg, and a magnetic flux density of $B_{50}$=16.75 KG. Therefore, in the case where the heat treatment is carried out at over 900° C., the magnetic properties of the silicon steel sheet containing 2.5% of silicon which was manufactured by a direct casting method were equivalent to the magnetic properties of the highest quality non-oriented silicon steel sheet. If the heat treatment temperature was 1050° C., the iron loss dropped less than $W_{15/50}$=2.3 W/KG, thereby showing superior magnetic properties.

Meanwhile, for an Fe-2.5%Si sheet which was manufactured by the direct casting method, the heat treatments were carried out variously by varying the heat treatment temperature. The variations of the (200) and (222) textures versus the heat treatment temperature are illustrated in FIG. 6.

Figure 6:
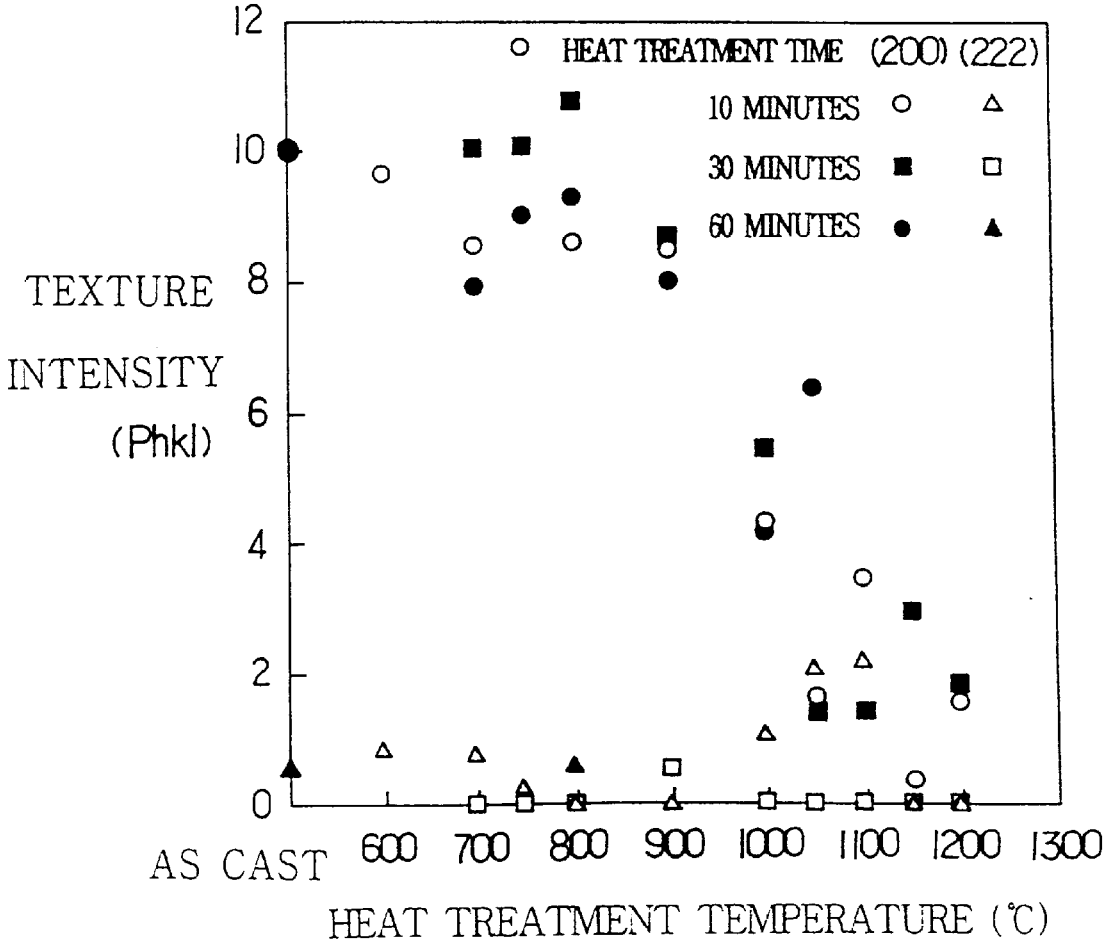
FIG. 6 is a graphical illustration showing the variation of the (200)(222) texture versus the heat treatment conditions for the directly cast silicon steel sheet.

As can be seen in FIG. 6, if the sheet was heat-treated at a temperature of 600–900° C., the texture coefficient $P_{200}$ of the (200) plane which is favorable for the magnetic properties showed to be 8 or more, while the texture coefficient $P_{222}$ of the (222) plane which is unfavorable for the magnetic properties showed to be 1 or less.

However, if the heat-treating temperature was 1000° C. or over, the (200) plane suddenly disappeared, while the (222) plane increased. In the case of the conventional electrical steel sheet (S14), $P_{200}$ was about 1.5, while $P_{222}$ was about 4. The improvement of the magnetic properties under the high temperature heat treatment is thought to be due to the fact that the grains are grown to large sizes in the relative terms. Further, in the present invention, if the heat treatment was carried out at a temperature of 600–900° C. after the rolling, a high concentration (200) plane was formed.

Example 3

Table 2 shows the variation of the magnetic properties versus the heat-treating time period for the directly cast Fe-2.5%Si sheet, the heat treatment being carried out at 1050° C. Even when the heat treatment was carried out for 10 minutes, the iron loss was very low. When the heat treatment time period was extended, the magnetic properties were not much affected. This phenomenon was same when the reduction rate was varied to 30% and 58%, and when the temperature was varied to 1050° C. and 1200° C. Ultimately, a heat treatment of even 3 minutes greatly contributed to the improvement of the magnetic properties.

<TABLE 2>

| Example | Heat-treating time (min) | Reduction rate (%) | Heat-treating temperature | Iron loss ($W_{15/50}$, W/kg) | Magnetic flux density ($B_{50}$, kg) |
|---|---|---|---|---|---|
| Inventive material 6 | 10 | 30 | 1050 | 2.31 | 16.4 |
| Inventive material 7 | 30 | 30 | 1050 | 2.14 | 16.5 |
| Inventive material 8 | 60 | 30 | 1050 | 2.2 | 16.55 |
| Inventive material 9 | 10 | 30 | 1200 | 1.78 | 17.76 |
| Inventive material 10 | 30 | 30 | 1200 | 1.91 | 17.74 |
| Inventive material 11 | 60 | 30 | 1200 | 1.86 | 17.62 |
| Inventive material 12 | 10 | 58 | 1050 | 2.26 | 16.8 |
| Inventive material 13 | 30 | 58 | 1050 | 2.3 | 16.85 |
| Inventive material 14 | 60 | 58 | 1050 | 2.18 | 16.6 |

Example 4

Table 3 shows the influence of the variation of the direct casting process to the magnetic properties after the heat treatment in an Fe-2.5%Si sheet. As to the sheet manufacturing method, the conventional rolling method was compared with the direct casting method. In the direct casting method, the single roll method and the twin-roll method were compared with each other. In the case of the single roll method, the casting speed was varied by 3 and 5 times as fast as the minimum speed under the given casting conditions.

As can be seen in Table 3, the directly cast sheets all showed superior magnetic properties under the heat treatment conditions of 1050° C. and 30 minutes. This owes to the fact that the directly cast sheet came to have superior texture after the finish treatment. That is, a relatively high (200) plane was formed after the finish treatment, while low (222) (211) planes were formed. On the other hand, in the case of the non-oriented electrical steel sheet, the (222) plane was formed to a high level.

When the directly cast sheet is finish-treated, the reason why the texture favorable for the magnetic properties is formed is that the texture before the cold rolling is different. That is, if an ingot is hot-rolled to make a sheet, the (222) plane is strongly formed. On the other hand, in the case of the directly cast sheet, the (200) plane is strongly formed. The reason is that the preferred plane during the casting is the (200) plane, and therefore, a strong (200) plane is formed on the surface of the material. For example, in the case of the single roll method, the (200) plane intensity $P_{200}$ is 7 or more. In the case of the twin-roll method, the value is as low as 2.3 on surface, while the internal value is as high as 5.5 (150 $\mu$m deep).

<TABLE 3>

| Example | Casting method | Tick-ness ($\mu$m) | Before rolling $P_{200}$ | Iron loss $W_{15/50}$, (W/kg) | Flux density $B_{50}$ (kg) | After finish treat $P_{200}$ | After finish treat $P_{222}$ |
|---|---|---|---|---|---|---|---|
| Inventive material 15 | single roll | 480 | 10.9 | 2.34 | 17.2 | 5.1 | 0.98 |
| Inventive material 16 | single roll | 266 | 8.4 | 1.74 | 17.5 | 3.1 | 0.59 |
| Inventive material 17 | single roll | 205 | 7.2 | 1.9 | 17.1 | 1.3 | 0 |
| Inventive material 18 | twin roll | 453 | 2.3 (5.5) | 2.64 | 16.7 | 2.3 | 0.74 |
| Conventional material | rolling method (S14) | 350 | <2 | 3.6 | 16.1 | 1.2–1.5 | 4 |

Example 5

In order to check the influence of the alloy elements to the magnetic properties, experiments were carried out by adding one or two elements selected from among Al, Mn and Sn.

Table 4 shows the variations of the magnetic properties versus the variation of the composition of the directly cast sheet. Except the conventional material, all the sheets of Table 4 were subjected to a reduction rate of 30%. Then heat treatments were carried out at 1050° C. for 30 minutes, and then, the iron loss and the magnetic properties were measured. The conventional material Fe-15%Si was manufactured by using an ingot.

When the composition was varied, the observed phenomena were as follows. Even when the content of silicon was varied, or even when Al, Mn and Sn were added singly or plurally, the same finish treatment results could be obtained.

<TABLE 4>

| Example | Composition | After heat treatment $W_{15/50}$ (W/kg) | After heat treatment $B_{50}$ (kg) | Before treatment $W_{15/50}$ (W/kg) |
|---|---|---|---|---|
| Conventional material | Fe −1.5% Si | — | — | 5.5–6 |
| Inventive material 19 | Fe −1.5% Si | 3.8 | 16.4 | 4.5 |
| Inventive material 20 | Fe −2.5% Si | 2.14 | 16.5 | 2.9 |
| Inventive material 21 | Fe −3.0% Si | 2.18 | 17.3 | 2.7 |
| Inventive material 22 | Fe −4.0% Si | 1.9 | 16.9 | 2.8 |
| Inventive material 23 | Fe −2.5% Si −0.6 Al | 2.5 | 17.4 | 3.1 |
| Inventive material 24 | Fe −2.5% Si −1.2% Al | 2.4 | 17.2 | 2.9 |
| Inventive material 25 | Fe −2.5% Si −0.6% Mn | 1.87 | 17.3 | 3.2 |
| Inventive material 26 | Fe −2.5% Si −1.2% Mn | 2.3 | 16.5 | 2.85 |
| Inventive material 27 | Fe −3.0% Si −0.6% Al | 2.4 | 16.8 | 3.4 |
| Inventive material 28 | Fe −3.0% Si −1.0% Al | 2.6 | 16.6 | 3.2 |
| Inventive material 29 | Fe −3.0% Si −0.6 Mn | 2.2 | 16.9 | 2.6 |
| Inventive material 30 | Fe −3.0% Si −1.2 Mn | 2.3 | 16.7 | 3.05 |
| Inventive material 31 | Fe −2.5% Si −0.6% Al −0.6% Mn | 2.1 | 16.7 | 2.9 |
| Inventive material 32 | Fe −2.5% Si −0.6% Al −0.6% Mn −0.3% Sn | 2.3 | 16.6 | 2.9 |

Figure 7:
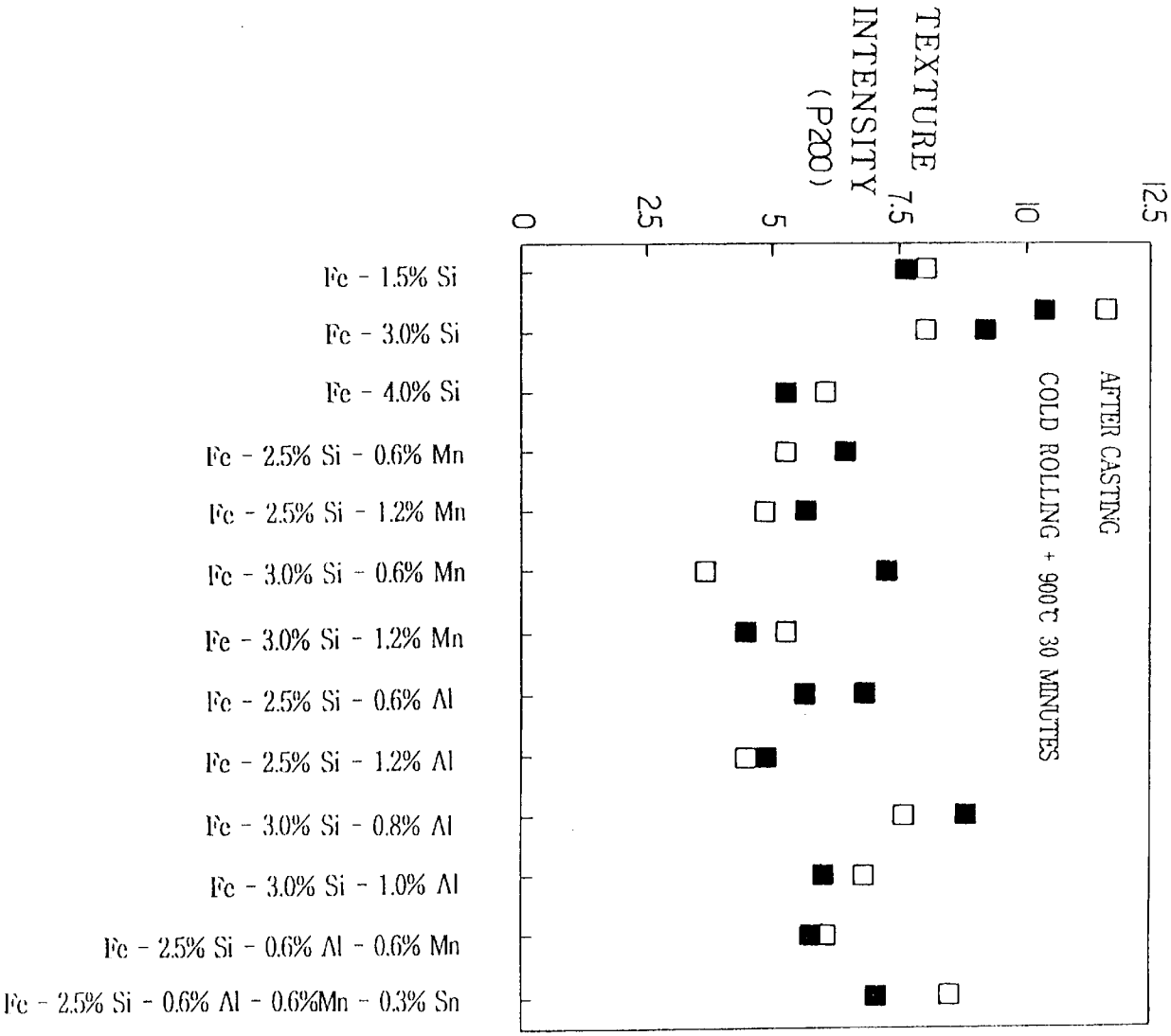
FIG. 7 is a graphical illustration showing the variation of the (200) texture versus the variation of the composition of the directly cast silicon steel sheet.

Meanwhile, when the sheet with Al, Mn and Sn added singly or plurally was heat-treated, a high density (200) texture could be obtained. FIG. 7 illustrates the (200) plane textures for test pieces of silicon steel sheets having different compositions, when they were heat-treated at 900° C. for 30 minutes. The sheets which were manufactured by the direct casting method showed a high density of the (200) plane even after the heat treatment.

According to the present invention as described above, the Fe-Si sheet which is manufactured by the direct casting method is subjected to a finish treatment. Consequently, The silicon steel sheet is made to have decreased surface defects and decreased thickness deviations. Therefore the directly cast silicon steel sheet can be put to the practical use, and can be made to have superior magnetic properties, so that it can be used as iron core of transformers, motors and the like.

What is claimed is:

1. A finish treatment method for a non-oriented silicon steel sheet manufactured by a direct casting method by directly contacting a molten pool to a cooling roll, comprising the steps of:

providing a direct cast silicon steel sheet having a high density (200) texture;

pickling the direct cast silicon steel sheet;

cold rolling the direct cast silicon steel sheet at a reduction rate of 15 to 80%; and heat-treating the cold rolled silicon steel sheet at a temperature of 600 to 1250° C.

2. The finish treatment method as claimed in claim 1, wherein said silicon steel sheet is composed of Fe-1.5–4%Si.

3. The finish treatment method as claimed in claim 1 wherein said silicon steel sheet is heat-treated at a temperature of 600–900° C.

4. The finish treatment method as claimed in claim 1, wherein said silicon steel sheet is heat-treated at a temperature of 1050–1250° C.

5. The finish treatment method as claimed in claim 1, wherein said silicon steel sheet is heat-treated for 3 minutes or more.

6. The finish treatment method as claimed in claim 1, wherein said casting roll is composed of a single roll or twin rolls.

7. The finish treatment method as claimed in claim 1 wherein said silicon steel sheet forms a (200) texture before and after the cold rolling.

8. A finish treatment method for a non-oriented silicon steel sheet manufactured by a direct casting method by directly contacting a molten pool to a single roll or twin rolls, comprising the steps of:

preparing an silicon steel composed of major ingredients Fe-1.5–4%Si, and one or two elements selected from a group consisting of 1.2 wt % or less of Al, 1.2 wt % or less of Mn, and 0.3 wt % or less of Sn;

direct casting the silicon steel to provide a silicon steel sheet having a high density (200) texture;

pickling said silicon steel sheet, and carrying out a cold rolling at a reduction rate of 15 to 80%; and heat-treating said silicon steel sheet at a temperature of 600–1250° C.

9. The finish treatment method as claimed in claim 2, wherein said silicon steel sheet forms a (200) texture before and after the cold rolling.

10. The finish treatment method as claimed in claim 5, wherein said silicon steel sheet forms a (200) texture before and after the cold rolling.

11. The finish treatment method as claimed in claim 7, wherein said silicon steel sheet forms a (200) texture before and after the cold rolling.

12. The finish treatment method as claimed in claim 8, wherein said silicon steel sheet forms a (200) texture before and after the cold rolling.

13. The finish treatment method as claimed in claim 9, wherein said silicon steel sheet forms a (200) texture before and after the cold rolling.

* * * * *

UNITED STATES PATENT AND TRADEMARK OFFICE

CERTIFICATE OF CORRECTION

PATENT NO. : 5,913,987

DATED : June 22, 1999

INVENTOR(S) : Jin Kyung Sung et al.

It is certified that error appears in the above-identified patent and that said Letters Patent is hereby corrected as shown below:

Title Page, in the title, [54} "AND" should read --FOR--.

Column 1, Line 1, in the Title, "AND" should read --FOR--.

Column 1 Line 22 "(iron loss)" should read --(iron or core loss)--.

Column 1 Line 24 "iron or core loss" should read --iron loss--.

Column 8 Line 11 Claim 3 after "in claim 1" insert comma --,--.

Column 8 Line 23 Claim 7 after "in claim 1" insert comma --,--.

Column 8 Line 44 Claim 10 "in claim 5" should read --in claim 3--.

Column 8 Line 47 claim 11 "in claim 7" should read --in claim 4--.

Column 8 Line 50 Claim 12 "in claim 8" should read --in claim 5--.

Column 8 Line 53 Claim 13 "in claim 9" should read --in claim 6--.

Signed and Sealed this

Fourth Day of January, 2000

*Attest:*

*Attesting Officer*

*Acting Commissioner of Patents and Trademarks*